US006901870B2

(12) United States Patent
Eklöf et al.

(10) Patent No.: US 6,901,870 B2
(45) Date of Patent: Jun. 7, 2005

(54) DEVICE AT AN EMBROIDERY FRAME AND METHOD FOR CLAMPING AND TENSIONING A TEXTILE MATERIAL

(75) Inventors: Petter Eklöf, Linköping (SE); Herman Arén, Åmål (SE); Per Svahn, Linköping (SE)

(73) Assignee: VSM Group AB, Huskvarna (SE)

( * ) Notice: Subject to any disclaimer, the term of this patent is extended or adjusted under 35 U.S.C. 154(b) by 0 days.

(21) Appl. No.: 10/735,818

(22) Filed: Dec. 16, 2003

(65) Prior Publication Data

US 2004/0244661 A1 Dec. 9, 2004

(30) Foreign Application Priority Data

Dec. 18, 2002 (SE) ..... 0203762

(51) Int. Cl.[7] ..... D05C 9/04
(52) U.S. Cl. ..... 112/103; 38/102.2
(58) Field of Search ..... 112/103, 475.18; 38/102, 102.2, 102.9, 102.91; 101/127.1; 160/371, 374.1, 375, 378, 380, 403

(56) References Cited

U.S. PATENT DOCUMENTS

| | | | | |
|---|---|---|---|---|
| 758,535 A | * | 4/1904 | Howden | 38/102.2 |
| 3,176,843 A | * | 4/1965 | Hoskins et al. | 209/403 |
| 3,968,033 A | * | 7/1976 | Illemann et al. | 209/403 |
| 4,357,869 A | * | 11/1982 | Wadstein | 101/127.1 |
| 4,483,323 A | * | 11/1984 | Murphy | 126/684 |
| 4,485,574 A | | 12/1984 | Bennetot | |
| 4,620,382 A | | 11/1986 | Sallis | |
| 5,129,171 A | | 7/1992 | Arbter et al. | |
| 5,555,653 A | | 9/1996 | Morgan | |

FOREIGN PATENT DOCUMENTS

| | | |
|---|---|---|
| DE | 3612079 | 10/1986 |
| DE | 3733886 | 10/1987 |
| EP | 0508211 | 10/1992 |

* cited by examiner

*Primary Examiner*—Ismael Izaguirre
(74) *Attorney, Agent, or Firm*—Venable LLP; Eric J. Franklin

(57) ABSTRACT

The present patent application relates to an embroidery frame for a sewing machine and a method for clamping and tensioning a textile material. The embroidery frame comprises an inner frame, an outer frame and a hose arranged between the inner frame and the outer frame, which hose is expandable through pressurization. After manual assembly of the inner frame and the outer frame, a textile material intended for embroidering can be clamped between the hose and the outer frame and tensioned over an area of the textile material intended for embroidering through pressurization of the hose. The hose expands through initial pressurization in an upper part and clamps thereby the textile material between the upper part of the hose and the outer frame. Upon continued pressurization the hose expands in a lower part in a direction towards the outer frame and tensions thereby the textile material.

26 Claims, 7 Drawing Sheets

DEVICE AT AN EMBROIDERY FRAME AND METHOD FOR CLAMPING AND TENSIONING A TEXTILE MATERIAL

FIELD OF THE INVENTION

The present invention relates to a device at an embroidery frame. More particularly, the present invention relates to a device at an embroidery frame for a sewing machine. The device includes an inner frame, an outer frame and a hose arranged between the inner frame and the outer frame. The hose is expandable through pressurization. Furthermore, the present invention also relates to a method for clamping and tensioning a textile material. More particularly, the present invention also relates to a method for clamping and tensioning a textile material in an embroidery frame for a sewing machine, wherein the embroidery frame includes an inner frame, an outer frame and a hose arranged between the inner frame and the outer frame, which hose is expanded through pressurization.

BACKGROUND OF THE INVENTION

When embroidering on a textile material it is desirable that the embroidery area of the textile material is kept as crease-free and as tensioned as possible in order to make the embroidery work as easy as possible. An embroidery frame is often used for tensioning and keeping the textile material in place. Traditionally, embroidery has been performed manually using embroidery frames of circular shape, which usually comprise one frame with a fix diameter and one frame with an adjustable circumference. The textile material intended for embroidering is clamped between the inner and the outer frames through adjusting the circumference of the outer frame by means of some type of mechanism such that the frames are pressed together. An interlining, of, for example, Vliseline, is usually placed as support under the textile material intended for embroidering. The interlining is clamped in the embroidery frame together with the textile material and is thus sewed on to the textile material when embroidering is performed. After embroidering is finished, the interlining is removed through, for example, tearing away.

Today, there are sewing machines with an embroidery function on the market, which are often provided with a separate embroidery unit for embroidering on a textile material. Such an embroidery unit is typically mounted onto the sewing machine as an extra unit and one embroidery frame with a clamped and tensioned textile material is attached to the embroidery unit. The embroidery frame may be moved around by means of the embroidery unit in a pre-programmed path such that stitches forming an embroidered pattern are placed on the clamped and tensioned textile material by the sewing machine. The development of sewing machines with an embroidery function implied that the need for embroidery frames having a rectangular shape increased, since rectangular embroidery frames utilize the rectangular working area of the sewing machine in a better way. In use of a rectangular embroidery frame based on the same principle as the above mentioned circular embroidery frame, the clamping force on the textile material will however be unequally distributed. A considerably greater clamping force is then obtained at the corners than at the sides, where the clamping force will be small. The manufacturers have tried to remedy the problem with keeping the textile material sufficiently clamped even at the sides by using, for example, clips that keep the inner and outer frames together, different types of interlinings and various profiles of the inner and outer frames. Another problem with many of the embroidery frames on the market today is that they require that a high force is applied manually, since the tensioning of the textile material is performed totally manually.

A well functioning embroidery frame should, among other things, typically imply an easy mounting and loosening of one textile material, that the textile material is strongly kept in place, that the textile material does not move during embroidering, that no marks are left on the textile material as well as that as many qualities of the textile material and as many different values of the thickness of the textile material as possible are possible to utilize. The length and the width of the embroidery frame are restricted by the size of the embroidery unit. Furthermore, the dimensions of the cross-section of one embroidery frame for one sewing machine are typically determined by the position of the foot and the size of the worktable.

It is previously known to provide a device, for example an embroidery frame, with a member that can be filled with a gas or a liquid and that tensions and clamps a material by increasing its diameter upon filling. An embroidery frame for industrial use is known from U.S. Pat. No. 5,129,171, which comprises a rigid component, a tensioning component and a tensioning tube. Material intended for embroidering is placed on the upper surface of the rigid component and the tensioning component is placed on the upper side of the material for initial clamping of the textile. The tensioning tube expands upon filling with a gas or a liquid and operates in a flute formed between the tensioning component and the rigid component. When the circumference of the tube is increased, the flute is initially expanded, which facilitates the movement for tensioning of the textile, and is finally narrowed, which implies that a strong clamping force is obtained at the end of the tensioning movement. Furthermore, the tensioning tube is crease-free with a bias-belted body comprising two layers of parallel strength-ensuring members, which imply that the textile depending on the angle they enclose with respect to a circumferential direction can be tensioned by increasing or decreasing the pressure alternatively, i.e. increasing or decreasing the circumferential length alternatively.

One disadvantage with the device in accordance with U.S. Pat. No. 5,129,171 is that a strong clamping of the textile is not achieved before after the tensioning of the textile. Furthermore, a relatively high pressure is required in one tube in accordance with U.S. Pat. No. 5,129,171 in order to by means of pressurization achieve expansion of the tube by increasing its diameter, i.e. stretching of the tube. A high pressure in the tube as well as the fact that the tube is to be stretched make great demands on the strength of the tube and on the inner and outer frames too, which are affected by the tube. The cost of production of such a tube, inner frame and outer frame will thereby be high.

SUMMARY OF THE INVENTION

One object of the present invention is to provide an improved device at an embroidery frame for a sewing machine.

This object is achieved through a device at an embroidery frame for a sewing machine. The embroidery frame includes an inner frame and an outer frame. A hose is arranged between the inner and outer frames. The hose is expandable through pressurization, whereby a textile material intended for embroidering is arranged to be clamped between the hose and the outer frame as well as tensioned over an area of the textile material intended for embroidering through pressurization of the hose after manual assembly of the inner frame and the outer frame. The hose is arranged through initial pressurization to expand in an upper part of the hose and thereby clamp the textile material between the upper part of the hose and the outer frame. Through continued pressurization the hose is arranged to continue to expand in the upper part and in a lower part of the hose in a direction towards the outer frame and thereby impart on the textile material a tensioning. The wall of the hose is designed in thickness and shape to, through pressurization, initially expand across the hose in the upper part and, through continued pressurization, continue to expand across the hose in the lower part. Thereby, a strong clamping of one textile material is initially achieved at the upper part and tensioning is thereafter achieved at the lower part due to that the hose has such a shape and thickness that it initially expands in the upper part and thereafter expands in the lower part upon pressurization.

According to a preferred embodiment, the hose includes at least one crease in at least one of an upper wall and a lower wall, whereby expansion of the hose is at least initially performed by strengthening of the at least one crease and not by stretching.

In one embodiment, the upper wall of the hose includes in a transverse direction of the hose at least one wave-shaped crease with a first crest of a wave having a first height in an unexpanded state and the lower wall of the hose includes in a transverse direction of the hose at least one wave-shaped crease with a second crest of a wave having a second height in an unexpanded state. Thereby, expansion of the hose may essentially be performed by straightening the at least one crease in the upper wall and the at least one crease in the lower wall and essentially not by stretching.

According to another embodiment, the second height is substantially higher than the first height, whereby straightening of the at least one crease in the upper wall before straightening of the at least one crease in the lower wall is facilitated.

According to one aspect of a preferred embodiment, a thickness of the upper wall may be substantially thinner than a thickness of the lower wall, whereby straightening of the at least one crease in the upper wall before straightening of the at least one crease in the lower wall is facilitated.

According to another aspect of a preferred embodiment, a wall of the hose intended to bear on the outer frame may include a recess at an inner circumference of the hose, whereby bending of the hose around any protruding part of the outer frame is facilitated.

Preferably, the inner frame has at an outer circumference an upper flange extending in a horizontal direction towards an intended location of the outer frame and a lower flange extending in a horizontal direction towards an intended location of the outer frame and wherein a recess intended for the hose is located between the upper flange and the lower flange, whereby mounting of the hose at the inner frame is facilitated.

According to one aspect of a preferred embodiment, the upper flange and the lower flange are wedge-shaped in a horizontal direction towards an intended location of the outer frame and wherein the thickness of the upper flange and the lower flange respectively is decreasing in a direction towards an intended location of the outer frame, whereby the hose is prevented from getting stuck in the inner frame and good loosening of the hose is achieved.

In one embodiment, the outer frame includes at an inner circumference a flange extending at a lower side of said outer frame in a horizontal direction towards an intended location of the inner frame. The outer frame also includes a surface inclining from an upper side of the outer frame in a downward direction towards the flange and towards an outer circumference. Furthermore, according to this embodiment the outer frame includes a recess formed in a transition from the inclining surface to the flange, whereby the flange has a longer extension in a horizontal direction towards an intended location of the inner frame than the inclining surface. Thereby, the initial clamping of the textile material is facilitated by the inclining surface and the final tensioning of the textile material is facilitated by the recess.

In another embodiment, the outer frame includes at an inner circumference a flange extending at a lower side of the outer frame in a horizontal direction towards an intended location of the inner frame, a shoulder extending at an upper side of the outer frame in a horizontal direction and a recess formed in a transition from the shoulder to the flange, whereby the flange has a longer extension in a horizontal direction towards an intended location of the inner frame than the shoulder. Thereby, the initial clamping of the textile material is facilitated by the shoulder and the final tensioning of the textile material is facilitated by the recess.

According to one aspect of a preferred embodiment, an end of the flange of the outer frame at the inner circumference of the outer frame is chamfered originating from an upper side of the flange and towards a lower side of the outer frame in a downward direction and towards an intended location of the inner frame, which end of the flange of the outer frame is designed to fit for bearing against an end of a lower flange at an outer circumference of the inner frame being chamfered originating from an upper side of the lower flange and towards a lower side of the lower flange in a downward direction and towards an inner circumference of the inner frame. Thereby, the inner and outer frames can be fit to each other and vertical forces between the inner frame and the outer frame can be received.

Preferably, a cross-section of the inner frame in a horizontal direction is substantially thicker than a cross-section of the outer frame in a horizontal direction, whereby the inner frame is able to withstand greater forces than the outer frame.

According to a further aspect of a preferred embodiment, the inner frame and the outer frame are rectangular, whereby the embroidery frame is well suited for a sewing machine having a rectangular working area.

Another object of the present invention is to provide an improved method for clamping and tensioning a textile material in an embroidery frame for a sewing machine.

This object is achieved through a method for clamping and tensioning a textile material in an embroidery frame for a sewing machine including an inner frame, an outer frame and a hose arranged between the inner frame and the outer frame, which hose is expanded through pressurization and is pressurized initially such that it expands in an upper part, whereby the textile material is clamped between the upper part of the hose and the outer frame and the hose is thereafter further pressurized such that it is expanded in a lower part, whereby the textile material is tensioned in a direction towards the outer frame, wherein the hose is pressurised initially such that the shape of the hose is rendered to change across the hose in the upper part and is thereafter further pressurized such that the shape of the hose is rendered to change across the hose in the lower part. Thereby a strong clamping of one textile material is initially achieved and tensioning of the textile material is thereafter achieved.

In one embodiment, the hose includes at least one crease in a transverse direction of the hose in an upper wall and at least one crease in a transverse direction of the hose in a lower wall is initially pressurized such that the at least one crease in a transverse direction of the hose in the upper wall is straightened, whereby the hose is expanded in the upper part and the textile material is clamped at the upper part of the hose between a wall of the hose and an inclining surface at an inner circumference of the outer frame, and the hose is thereafter further pressurised such that the at least one crease in the lower wall of the hose is straightened, whereby a lower part of the hose is expanded into a recess in an inner circumference of the outer frame and the textile material is tensioned in a direction towards the outer frame along a flange of the outer frame. Thereby, clamping is initially achieved of one textile material against the inclining surface through straightening of the at least one crease in the upper wall and tensioning is thereafter achieved through straightening of the at least one crease in the lower wall and expansion of the hose into the recess.

In another embodiment, the hose includes at least one crease in a transverse direction of the hose in an upper wall and at least one crease in a transverse direction of the hose in a lower wall is initially pressurized such that the at least one crease in the upper wall is straightened, whereby the hose is expanded in the upper part and the textile material is clamped at the upper part of the hose between a wall of the hose and a shoulder extending in a horizontal direction at an upper side of the outer frame, and the hose is thereafter further pressurized such that the at least one crease in the lower wall of the hose is straightened, whereby a lower part of the hose is expanded into a recess in an inner circumference of the outer frame, the textile material is folded around a corner of the shoulder at a recess in an inner circumference of the hose and the textile material is tensioned in a direction towards the outer frame along a flange of the outer frame. Thereby, clamping is initially achieved of one textile material against the shoulder through straightening of the at least one crease in the upper wall and tensioning is thereafter achieved through straightening of the at least one crease in the lower wall and expansion of the hose into the recess.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The present invention will in the following be described in more detail with reference to the accompanying drawings, in which.

DETAILED DESCRIPTION OF EMBODIMENTS

Figure 1:
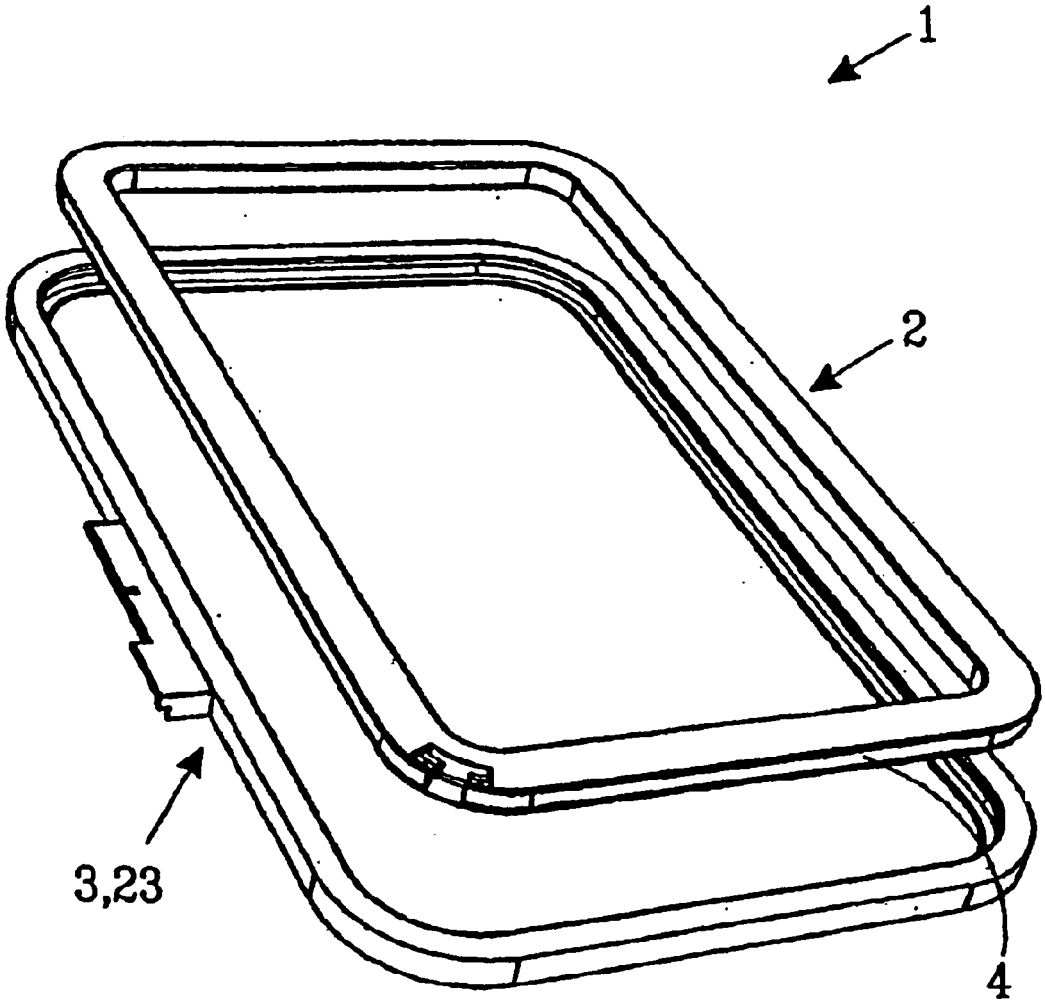
FIG. 1 shows a perspective view of an embodiment of an embroidery frame being non-assembled.

FIG. 1 shows a perspective view of an embroidery frame 1 of rectangular shape in accordance with a preferred embodiment. The embodiment of the embroidery frame 1 is intended to be used for fastening and tensioning a textile material for permitting embroidering on the textile material by a sewing machine. Furthermore, the embodiment of the embroidery frame 1 is intended to be mounted in an embroidery unit of a sewing machine. The embroidery frame 1 may be moved around by the embroidery unit in accordance with a pre-programmed pattern, whereby an embroidered pattern is created when stitches are placed on the textile material. The embodiment of the embroidery frame 1 includes an inner frame 2, an outer frame 3, 23 and a hose 4 arranged at the inner frame 2, which hose 4 is expandable by means of pressurization. The inner frame 2 and the outer frame 3, 23 have shapes that are adapted to each other in order to enable assembly of the inner frame 2 and the outer frame 3, 23 as well as clamping of a textile material and the hose 4 therebetween. Assembly of the frames may be performed by manually squeezing them together by means of a relatively small hand power. The embroidery frame 1 and its members are below described having such an orientation that the embroidery frame 1 is typically intended to have in normal use.

Figure 2A:
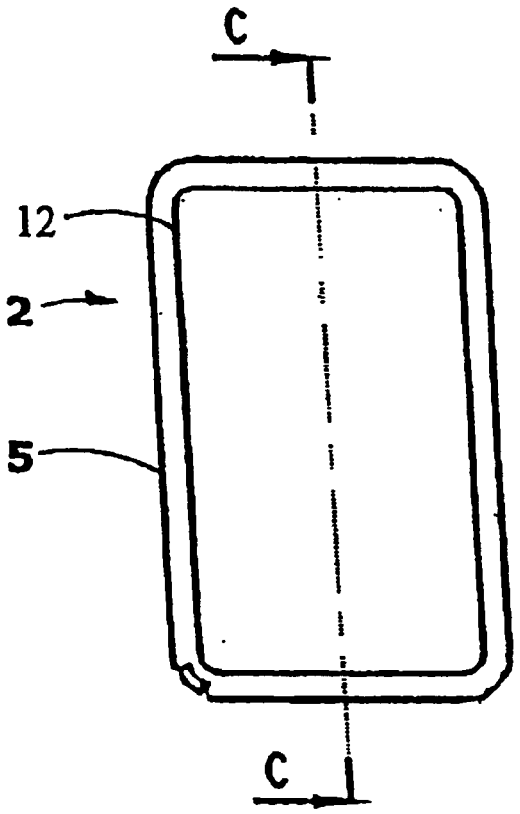
FIG. 2A shows a top view of an embodiment of an inner frame.
Figure 2B:
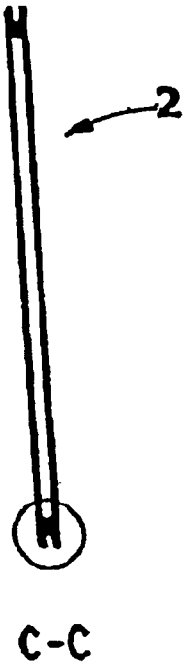
FIG. 2B shows a cross-section taken along line C—C in FIG. 2A.
Figure 2C:
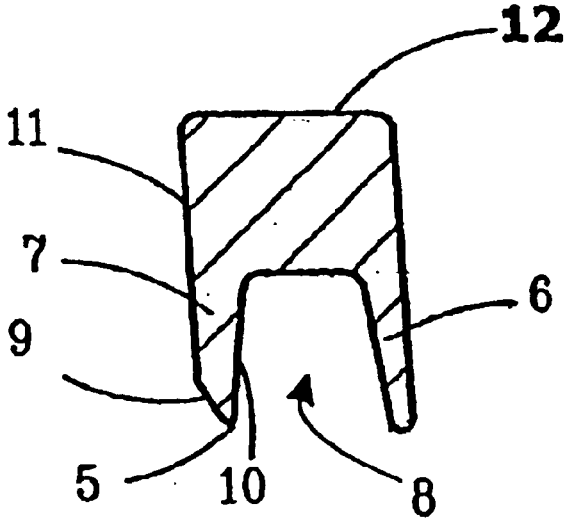
FIG. 2C shows an enlarged view of the marked area in FIG. 2B.

FIGS. 2A–C show an embodiment of the inner frame 2 in a top view, a cross-section along line C—C and an enlarged view of a marked part of the cross-section along line C—C, respectively. This embodiment of the inner frame 2 is of rectangular shape and has an upper flange 6 and a lower flange 7 at an outer circumference 5. The flanges 6, 7 in this embodiment extend along the complete outer circumference 5 and are arranged to keep the expandable hose 4 in place. There is a recess 8 between the flanges 6, 7, which is intended for the hose 4. The recess 8 is preferably designed as large as possible, since it for purposes of pressurization of the hose 4 is desirably to find room for one hose 4 that is as large as possible. However, the design of the recess 8 may be restricted by the demands on the strength of the upper flange 6 and the lower flange 7, i.e. the flanges 6,7 have to be designed with such a thickness of material respectively that they can withstand pressurization of the hose 4. Furthermore, the design of the recess 8 may be restricted by the dimensions of the cross-section of the embroidery frame 1 in a vertical direction, which as mentioned above may be restricted by the position of the foot and the size of the worktable. The flanges 6, 7 may also be shaped to prevent the hose 4 from getting stuck in the recess 8 as well as permit good loosening of the hose 4. Consequently, the flanges 6,7 may be wedge-shaped seen in a cross-section, which is apparent from FIG. 2C, and their thickness respectively may decrease in a direction of the outer circumference 5. The thickness of the flanges 6,7 respectively may be greatest at the very back of the recess 8 in order to be able to better take up the forces appearing at pressurization of the hose 4.

Furthermore, the cross-section of the inner frame 2 may be thicker in a horizontal direction than the cross-section of the outer frame 3, since the inner frame 2 typically has to withstand greater forces than the outer frame 3. The inner frame 2 may take up forces originating from the expansion of the hose 4 at pressurization, the resistance of the outer frame 3 and the tensile forces of the textile material. An end 9 of the lower flange 7 may be chamfered at the outer circumference 5 originating from an upper side 10 of the lower flange 7 and towards a lower side 11 of the lower flange 7 in a downward direction and towards an inner circumference 12 of the inner frame 2.

Figure 3A:
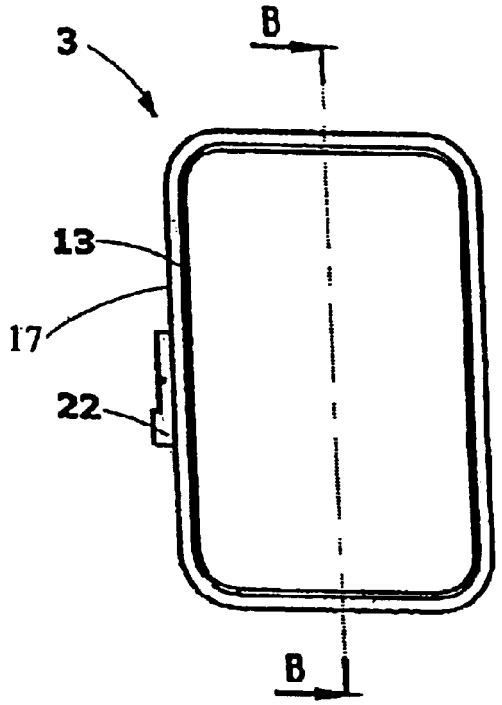
FIG. 3A shows a top view of an outer frame in accordance with a preferred embodiment.
Figure 3B:
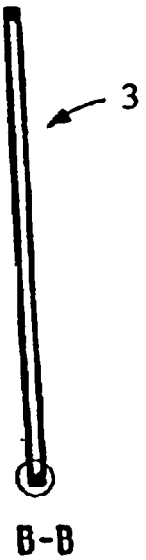
FIG. 3B shows a cross-section taken along line B—B in FIG. 3A.
Figure 3C:
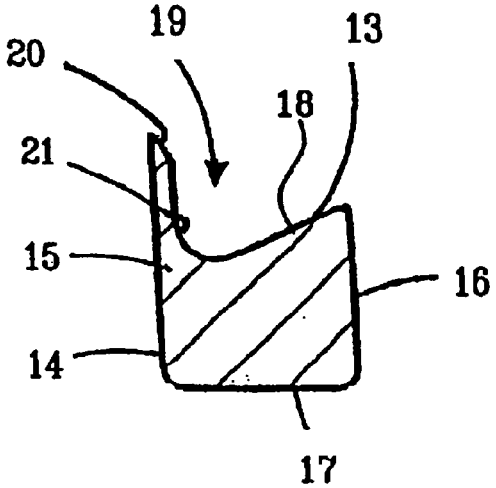
FIG. 3C shows an enlarged view of the marked area in FIG. 3B.

FIGS. 3A–C show the outer frame 3 in accordance with a preferred embodiment in a top view, a cross-section along line B-B and an enlarged view of a marked part of the cross-section along line B—B, respectively. The outer frame 3 may have a rectangular shape and may have a flange 15 at an inner circumference 13 at a lower side 14 of the outer frame 3, which flange 15 extends in a horizontal direction towards an intended location of the inner frame 2. Furthermore, the outer frame 3 may have at the inner circumference 13 a surface 18 inclining from an upper side 16 of the outer frame 3 in a downward direction towards the flange 15 and towards an outer circumference 17. The flange 15 may have a longer extension in a horizontal direction towards an intended location of the inner frame 2 than the inclining surface 18. A recess 19 may be located in the transition from the inclining surface 18 to the flange 15.

In use of the embroidery frame 1 comprising the preferred embodiment of the outer frame 3 for clamping and tensioning one textile material, the textile material may initially be clamped between the outer frame 3 and the inner frame 2, which has one non-pressurized hose 4 mounted in the recess 8. Preferably, this is performed through assembly of the outer frame 3 and the inner frame 2 using hand power. In most cases, however, the initial clamping will not imply a sufficient clamping force and not a sufficiently smooth embroidery area, i.e. the textile material may not be kept in place sufficiently strong and may not be sufficiently tensioned. After assembly of the outer frame 3 and the inner frame 2, the hose 4 may be pressurized, whereby the hose 4 initially expands and clamps the textile material against the inclining surface 18 by bearing thereon. Thus, the textile material may be clamped between the hose 4 and the inclining surface 18 of the outer frame 3 upon pressurization of the hose 4 and thereby a substantially stronger clamping force may be achieved than the clamping force achieved upon assembly of the outer frame 3 and the inner frame 2 with one non-pressurized hose 4. The recess 19 is intended for the hose 4 to expand into after clamping of the textile material against the inclining surface 18. Through expansion of the hose 4 into the recess 19, the hose 4 may drag the textile material along the flange 15 in a direction towards the outer frame 3, whereby the textile material is tensioned over the embroidery area.

The outer frame 3 may be subjected to smaller forces than the inner frame 2 and, as above mentioned, the cross-section in a horizontal direction of the outer frame 3 may be thinner than the cross-section of the inner frame 2. The force loading the outer frame 3 is the clamping force appearing between the textile material and the outer frame 3. Furthermore, an end 20 of the flange 15 of the outer frame 3 may be chamfered at the inner circumference 13 of the outer frame 3 originating from an upper side 21 of the flange 15 and towards a lower side 14 of the outer frame 3 in a downward direction and towards an intended location of the inner frame 2. The end 20 of the flange 15 of the outer frame 3 may be chamfered in order to be fit to the chamfered end 9 of the lower flange 7 of the inner frame 2 for receiving vertical forces between the inner frame 2 and the outer frame 3. An attachment 22 may be arranged at the outer circumference 17 for attachment of the embroidery frame 1 to one embroidery unit of one sewing machine.

Figure 4A:
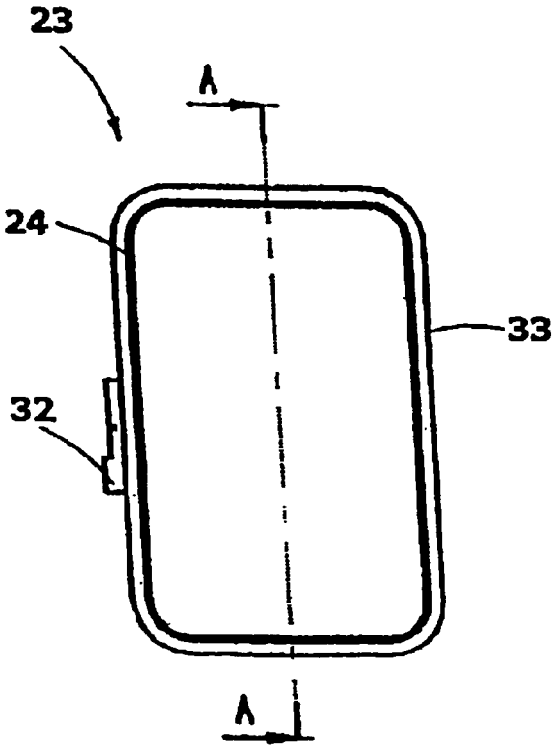
FIG. 4A shows a top view of an outer frame in accordance with an alternative embodiment.
Figure 4B:
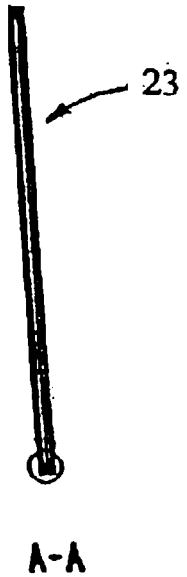
FIG. 4B shows a cross-section taken along line A—A in FIG. 4A.
Figure 4C:
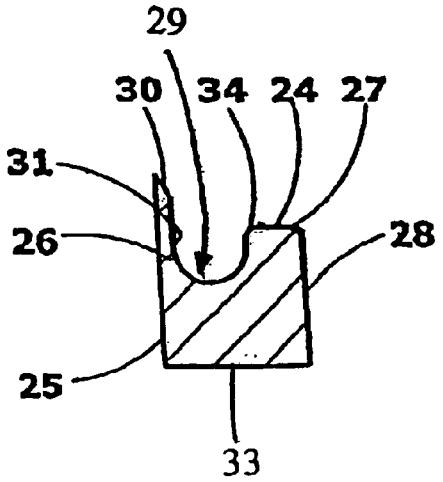
FIG. 4C shows an enlarged view of the marked area in FIG. 4B.

FIGS. 4A–C show an alternative embodiment of the outer frame 23 in a top view, a cross-section along line A—A and an enlarged view of a marked part of the cross-section along line A—A, respectively. The outer frame 23 is intended to be used in conjunction with the inner frame 2 and the hose 4 in the same way as above described for the preferred embodiment of the outer frame 3, which is shown in FIGS. 3A–C. The embodiment of the outer frame 23 shown in FIGS. 4A–C is of rectangular shape and has a flange 26 at an inner circumference 24 at a lower side 25 of the outer frame 23, which flange 26 extends in a horizontal direction towards an imagined centre of the outer frame 23. Furthermore, this embodiment of the outer frame 23 has at the inner circumference 24 at an upper side 28 a shoulder 27, which extends in a horizontal direction towards an intended location of the inner frame 2. In the transition from the shoulder 27 to the flange 26 there is a recess 29. The flange 26 extends longer in a horizontal direction towards an intended location of the inner frame 2 than the shoulder 27 and the recess 29.

In use of the outer frame 23 in the embroidery frame 1, the textile material may initially be clamped between the inner frame 2 with one non-pressurized hose 4 and the outer frame 23 through manual assembly of the inner frame 2 and the outer frame 23 by means of hand power. The hose 4 mounted in the recess 8 of the inner frame 2 may then be pressurized, whereby the hose 4 initially expands and clamps the textile material against the shoulder 27 by a stronger and typically substantially stronger force compared to the force achieved upon the manual assembly of the outer frame 3 and the inner frame 2 with one non-pressurized hose 4. The recess 29 is intended for the hose 4 to expand into for tensioning of the textile material after clamping against the shoulder 27.

The outer frame 23 typically is subjected to smaller forces than the inner frame 2 and the cross-section of the outer frame 23 can thus be made thinner in a horizontal direction than the cross-section of the inner frame 2. Furthermore, an end 30 of the flange 26 of the outer frame 23 may be chamfered at the inner circumference 24 of the outer frame 23 originating from an upper side 31 of the flange 26 and towards the lower side 25 of the outer frame 23 in a downward direction and towards an intended location of the inner frame 2. The end 30 of the flange 26 of the outer frame 23 may be chamfered in order to be fit to the chamfered end 9 of the lower flange 7 of the inner frame 2 for receiving vertical forces between the inner frame 2 and the outer frame 23. An attachment 32 may be arranged at the outer circumference 33 for attachment of the embroidery frame 1 to one embroidery unit of one sewing machine.

Figure 5A:
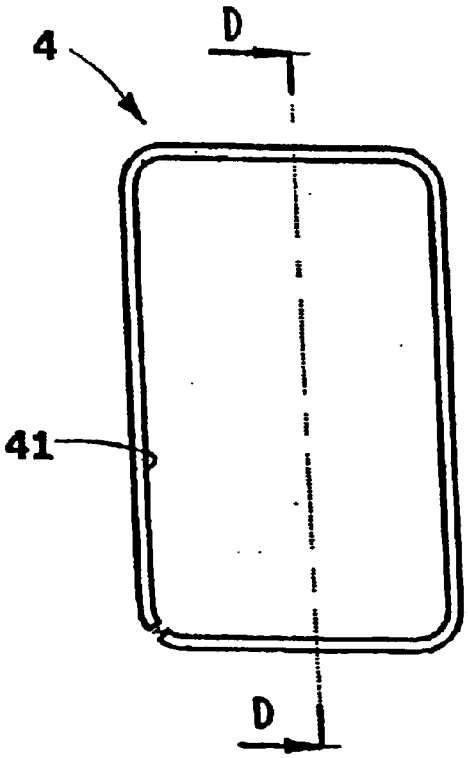
FIG. 5A shows a top view of an embodiment of an expandable hose.
Figure 5B:
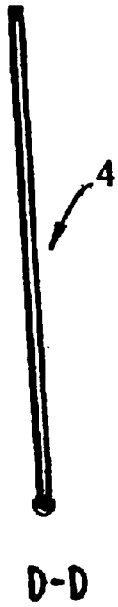
FIG. 5B shows a cross-section of the hose along line D—D in FIG. 5A.
Figure 5C:
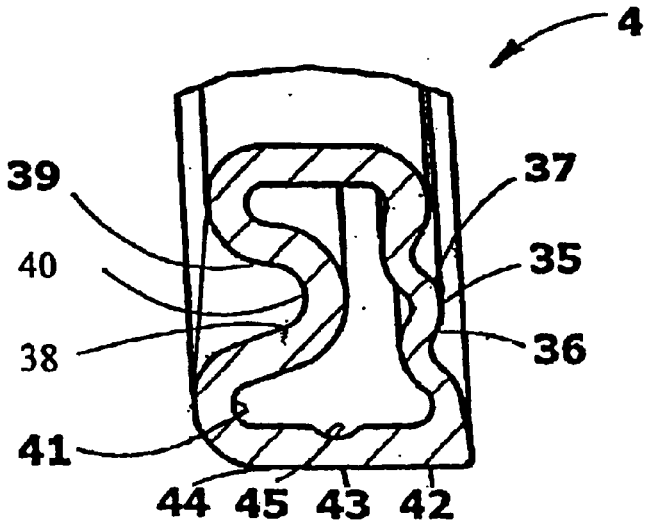
FIG. 5C shows an enlarged view of the marked area in FIG. 5B.

FIGS. 5A–C show an embodiment of the hose 4 in a top view, a cross-section of the hose 4 along line D—D and an enlarged view of a marked part of the cross-section along line D—D, respectively. The hose 4 may be mounted in the recess 8 of the inner frame 2 and may be kept in place as above described by the upper flange 6 and the lower flange 7, whose wedge-shape may also help to improve the strength and to prevent the hose 4 from getting stuck in the recess 8. The hose 4 may be expandable through pressurization, which for example can be performed by means of a pumping device or the like. Seen in a cross-section in an unexpanded state, which is shown in FIG. 5C, an upper wall 35 of the hose 4 may be folded in a transverse direction of the hose 4 and may include at least one crease 36, whereby the at least one crease 36 of the upper wall 35 traces a wave having one first crest of a wave 37 with a first height. In a preferred embodiment of the hose 4, the upper wall 35 may include two crests of a wave 37 with a first height, i.e. two creases 36. In an unexpanded state, a lower wall 38 may also be folded in a transverse direction of the hose 4 and comprises at least one crease 39, whereby the at least one crease 39 of the lower wall 38 traces a wave having one second crest of a wave 40 with a second height. The lower wall 38 may include one crest of a wave 40 with a second height, i.e. one crease 39, in a preferred embodiment of the hose 4.

The first height may be substantially smaller than the second height, whereby each of the at least one crease 36 of the upper wall 35 may be substantially smaller than each of the at least one crease 39 of the lower wall 38. The upper wall 35 and the lower wall 38 are due to the at least one crease 36 and the at least one crease 39 contracted. Upon pressurization the hose 4 may expand through straightening the creases 36, 39, which may require a lower pressure compared to using a hose that is crease-free and that upon pressurization must expand trough increasing the circumference. The possibility to use a lower pressure implies a lower stress on the inner frame 2 and the outer frame 3, 23. Furthermore, expansion of the hose 4 in accordance with the present invention through straightening of the creases 36, 39 implies that the hose 4 does not need to be stretched to any appreciable extent upon pressurization, which reduces the strength demands of the hose 4 and has a positive effect on the length of life of the hose 4.

The number of creases 36 of the upper wall 35 and the size of the first height as well as the number of creases 39 of the lower wall 38 and the size of the second height may be restricted by that the first height, as above mentioned, may be substantially lower than the second height and that the at least one crease 36 and the at least one crease 39 preferably will not bear against and affect each other. Consequently, there typically is a distance between the at least one crease 36 of the upper wall 35 and the at least one crease 39 of the lower wall 38 at an inner circumference 41 of the hose 4.

The thickness of the upper wall 35 may be less than the thickness of the remaining parts of the hose 4. Upon pressurization the hose 4 may expand at the upper wall 35 in a first phase, since the thickness of the upper wall 35 is substantially thinner than the thickness of the lower wall 38. Expansion of the hose 4 at the upper wall 35 implies that the at least one crease 36 is straightened, whereby the hose 4 may expand in an upper part 42 of the hose 4 and clamp the textile material against the outer frame 3, 23 at a wall 43 intended to face the outer frame 3, 23. As mentioned above, the textile material may be clamped against the inclining surface 18 in use of the preferred embodiment of the outer frame 3 and against the shoulder 27 in use of the alternative embodiment of the outer frame 23.

Upon continued pressurization of the hose 4 after that the at least one crease 36 has been straightened and that the hose 4 bears against the outer frame 3, 23, the hose 4 may expand in a second phase in a lower part 44 of the hose 4. The at least one crease 39 in the lower wall 38 may thereby be straightened through the hose 4 expanding into the recess 19, 29 of the outer frame 3, 23, whereby the textile material may be dragged along the flange 15, 26 and may be tensioned in a direction towards the outer frame 3, 23. The textile material may then be further tensioned upon increased pressure in the hose 4 until the outer frame 3, 23 or the textile material restricts the tensioning. Upon pressurization of the hose 4, a clamping force may thus be initially obtained that clamps the textile material against the outer frame 3, 23 and upon continued pressurization, a tensioning of the textile material may be obtained at the same time as the clamping force is further increased.

An inner side of the wall 43 may include a recess 45, which in use of the alternative embodiment of the outer frame 23 is intended to facilitate for the hose 4 to upon pressurization be bent around a corner 34 of the shoulder 27 of the outer frame 23.

Figure 6A:
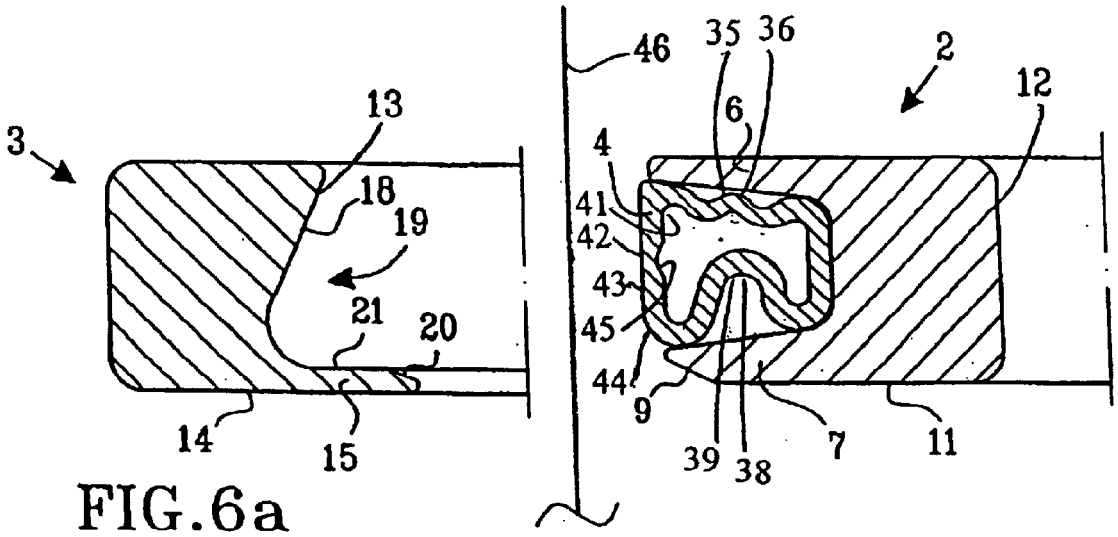
FIG. 6A shows a cross-section of the outer frame in accordance with FIGS. 3A–C, the inner frame in accordance with FIGS. 2A–C with the hose in accordance with FIGS. 5A–C fastened and the textile material before assembly of the inner frame and the outer frame.
Figure 6B:
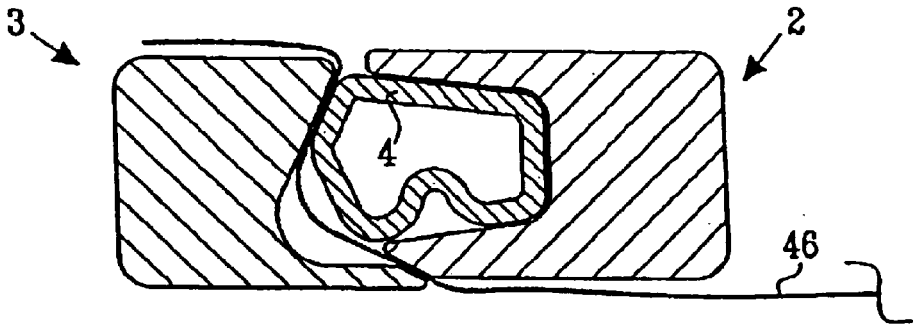
FIG. 6B shows a cross-section of the outer frame in accordance with FIGS. 3A–C and the inner frame in accordance with FIGS. 2A–C with the hose in accordance with FIGS. 5A–C fastened, whereby the textile material is clamped after assembly of the inner frame and the outer frame and after a first phase of expansion of the hose.
Figure 6C:
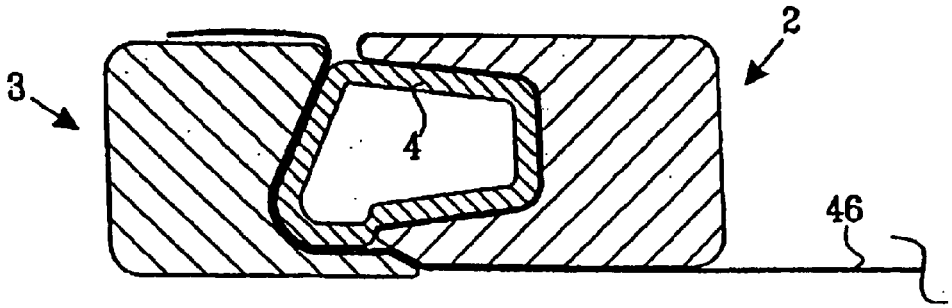
FIG. 6C shows a cross-section of the outer frame in accordance with FIGS. 3A–C, the inner frame in accordance with FIGS. 2A–C with the hose in accordance with FIGS. 5A–C fastened, whereby the textile material is clamped after assembly of the inner frame and the outer frame and after a first phase of expansion of the hose as well as tensioned after a second phase of expansion of the hose.

FIGS. 6A–C show the different phases during an embodiment of a method of clamping of a textile material 46 between the inner frame 2 and the outer frame 3 and tensioning of the textile material 46. In accordance with this embodiment, FIG. 6A shows in a cross-sectional view the textile material 46 between the outer frame 3 and the inner frame 2, whereby the hose 4 is non-pressurized and arranged in the recess 8 between the upper flange 6 and the lower flange 7, before manual assembly of the inner frame 2 and the outer frame 3 by hand power. Further in accordance with this embodiment, FIG. 6B shows in a cross-sectional view the textile material 46 clamped in the embroidery frame 1 after manual assembly of the inner frame 2 and the outer frame 3 and after a first phase of expansion of the hose 4, i.e. after straightening of the at least one crease 36 in the upper wall 35 of the hose 4 and clamping of the textile material 46 of the upper part 42 of the hose 4 at the wall 43 against the inclining surface 18 of the outer frame 3. FIG. 6C shows in a cross-sectional view the textile material 46 after manually clamping in the embroidery frame 1, after clamping during a first phase of expansion of the hose 4 and after tensioning during a second phase of expansion of the hose 4, i.e. after straightening of the at least one crease 39 in the lower wall 38 of the hose 4 and tensioning of the textile material 46 along the flange 15 by expansion of the lower part 44 of the hose 4 into the recess 19.

Figure 7A:
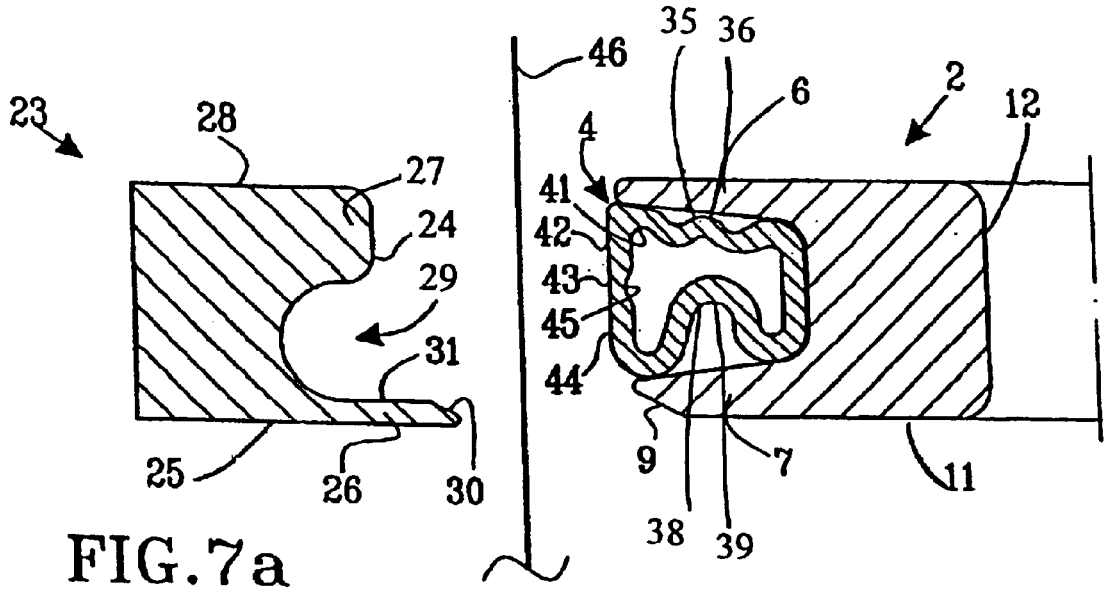
FIG. 7A shows a cross-section of the outer frame in accordance with FIGS. 4A–C, the inner frame in accordance with FIGS. 2A–C with the hose in accordance with FIGS. 5A–C fastened and the textile material before assembly of the inner frame and the outer frame.
Figure 7B:
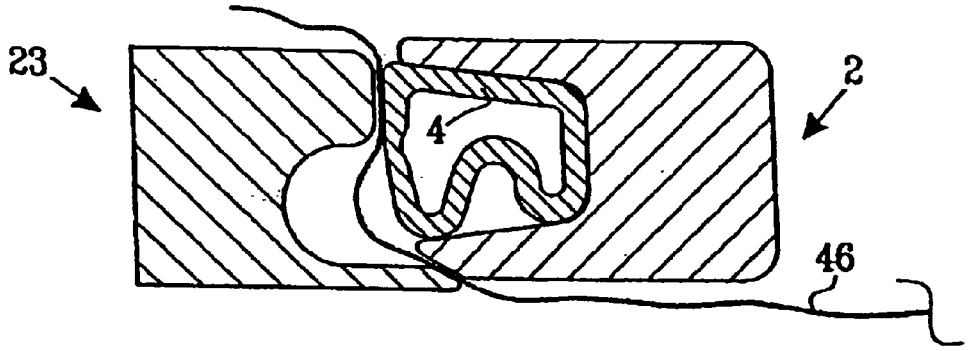
FIG. 7B shows a cross-section of the outer frame in accordance with FIGS. 4A–C and the inner frame in accordance with FIGS. 2A–C with the hose in accordance with FIGS. 5A–C fastened, whereby the textile material is clamped after assembly of the inner frame and the outer frame and after a first phase of expansion of the hose.
Figure 7C:
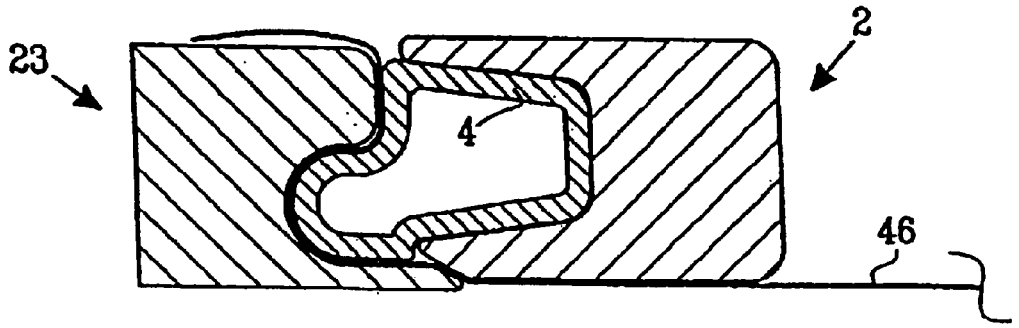
FIG. 7C shows a cross-section of the outer frame in accordance with FIGS. 4A–C and the inner frame in accordance with FIGS. 2A–C with the hose in accordance with FIGS. 5A–C fastened, whereby the textile material is clamped after assembly of the inner frame and the outer frame and after a first phase of expansion of the hose as well as tensioned after a second phase of expansion of the hose.

FIGS. 7A–C show the different phases during an embodiment of a method for clamping of one textile material 46 between the inner frame 2 and the outer frame 23 and tensioning of the textile material 46. According to this embodiment, FIG. 7A shows in a cross-sectional view the textile material 46 between the outer frame 23 and the inner frame 2, whereby the hose 4 is non-pressurized and arranged in the recess 8 between the upper flange 6 and the lower flange 7, before manual assembly of the inner frame 2 and the outer frame 23 by hand power. FIG. 7B shows in a cross-sectional view the textile material 46 clamped in the embroidery frame 1 after manual assembly of the inner frame 2 and the outer frame 23 and after a first phase of expansion of the hose 4, i.e. after straightening of the at least one crease 36 in the upper wall 35 of the hose 4 and clamping of the textile material 46 of the upper part 42 of the hose 4 at the wall 43 against the shoulder 27 of the outer frame 23. FIG. 7C shows in a cross-sectional view the textile material 46 after manually clamping in the embroidery frame 1, after clamping during a first phase of expansion of the hose 4 and after tensioning during a second phase of expansion of the hose 4, i.e. after straightening of the at least one crease 39 in the lower wall 38 of the hose 4 at the wall 43 and tensioning of the textile material 46 along the flange 26 by expansion of the lower part 44 of the hose 4 into the recess 29.

The frame members may be made of a variety of materials, such as plastic(s), metal and composite materials, for example. A composite material having polycarbonate as matrix, polycarbonate having 30% carbon fibres, is preferably used as material for the inner frame 2 and the outer frame 3, such that the material fulfils certain demands. For example, the material used typically should be able to withstand the stress that the hose 4 gives rise to and not permit a large deflection of the flanges. The choice of the material of the hose 4 may be determined by the manufacturing process, which for the present hose 4 preferably is extrusion. However, other manufacturing processes may be utilized. Naturally, other materials may also be utilized.

The embroidery frame in accordance with the present invention typically requires few operations by the hands of the user and a small hand power for assembly. The clamping force may be equally distributed around the embroidery frame 1 and a tensioning may be automatically obtained. Furthermore, the embroidery frame typically leaves only small marks in the textile material if the corners of the frame are rounded and rounded corners less abruptly deflect the textile material . The marks may be formed in the corners of the embroidery frame 1 by the lower flange 7 of the inner frame 2. Since the hose 4 typically does not expand fully in the corners of the embroidery frame 1, the textile material may bear considerably more against the lower flange 7 of the inner frame 1 in the corners than along the sides.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, a hose having another cross-section, for example a circular cross-section, may be utilized instead of the hose described above having a folded cross-section and the hose may be made of another material than that mentioned above. The cross-section of the outer frame could have another shape, for example a compromise between the preferred embodiment and the alternative embodiment of the outer frame. The recess of the inner frame could also have another shape and size. Furthermore, it could be possible to use two or more hoses, one for the clamping movement and one for the tensioning movement in order to achieve both the clamping function and the tensioning function. It is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice.

We claim:

1. A device at an embroidery frame for a sewing machine, the device comprising an inner frame and an outer frame, between which inner and outer frames a hose is arranged, said hose being expandable through pressurization, whereby a textile material intended for embroidering is arranged to be clamped between said hose and said outer frame as well as tensioned over an area of the textile material intended for embroidering through pressurization of said hose after manual assembly of said inner frame and said outer frame and whereby said hose is arranged to through initial pressurization expand in an upper part of said hose and thereby clamp the textile material between said upper part of said hose and said outer frame as well as to through continued pressurization continue to expand in said upper part and in a lower part of said hose in a direction towards said outer frame and thereby impart on the textile material a tensioning, wherein the wall of said hose in thickness and shape is designed to, through pressurization, initially expand across said hose in said upper part and, through continued pressurization, continue to expand across said hose in said lower part.

2. The device according to claim 1, wherein said hose comprises at least one crease in at least one of an upper wall and a lower wall.

3. The device according to claim 2, wherein said upper wall of said hose in a transverse direction of said hose comprises at least one wave-shaped crease with a first crest of a wave having a first height in an unexpanded state and said lower wall of said hose in a transverse direction of said hose comprises at least one wave-shaped crease with a second crest of a wave having a second height in an unexpanded state.

4. The device according to claim 3, wherein said second height is substantially higher than said first height.

5. The device according to a claim 2, wherein a thickness of said upper wall is substantially thinner than a thickness of said lower wall.

6. The device according to claim 1, wherein a wall of said hose intended to bear on said outer frame comprises a recess at an inner circumference of said hose.

7. The device according to claim 1, wherein said inner frame at an outer circumference has an upper flange extending in a horizontal direction towards an intended location of said outer frame and a lower flange extending in a horizontal direction towards an intended location of said outer frame and wherein a recess intended for said hose is located between said upper flange and said lower flange.

8. The device according to claim 7, wherein said hose comprises at least one crease in at least one of an upper wall and a lower wall.

9. The device according to claim 7, wherein said upper flange and said lower flange are wedge-shaped in a horizontal direction towards an intended location of said outer frame and wherein the thickness of said upper flange and said lower flange respectively is decreasing in a direction towards an intended location of said outer frame.

10. The device according to claim 7, wherein an end of said lower flange at an outer circumference of said inner frame is chamfered originating from an upper side of said lower flange and towards a lower side of said lower flange in a downward direction and towards an inner circumference of said inner frame.

11. The device according to claim 1, wherein said outer frame at an inner circumference comprises a flange extending at a lower side of said outer frame in a horizontal direction towards an intended location of said inner frame, a surface inclining from an upper side of said outer frame in a downward direction towards said flange and towards an outer circumference, and a recess formed in a transition from said inclining surface to said flange, whereby said flange has a longer extension in a horizontal direction towards an intended location of said inner frame than the inclining surface.

12. The device according to claim 11, wherein said hose comprises at least one crease in at least one of an upper wall and a lower wall.

13. The device according to claim 11, wherein an end of said flange of said outer frame at the inner circumference of said outer frame is chamfered originating from an upper side of said flange and towards a lower side of said outer frame in a downward direction and towards an intended location of said inner frame.

14. The device according to claim 13, wherein said end of said flange of said outer frame is designed to fit for bearing against an end of a lower flange at an outer circumference of said inner frame, which end is chamfered originating from an upper side of said lower flange and towards a lower side of said lower flange in a downward direction and towards an inner circumference of said inner frame.

15. The device according to claim 1, wherein said outer frame at an inner circumference comprises a flange extending at a lower side of said outer frame in a horizontal direction towards an intended location of said inner frame, a shoulder extending at an upper side of said outer frame in a horizontal direction and a recess formed in a transition from said shoulder to said flange, whereby said flange has a longer extension in a horizontal direction towards an intended location of said inner frame than said shoulder.

16. The device according to claim 15, wherein said hose comprises at least one crease in at least one of an upper wall and a lower wall.

17. The device according to claim 15, wherein an end of said flange of said outer frame at the inner circumference of said outer frame is chamfered originating from an upper side of said flange and towards a lower side of said outer frame in a downward direction and towards an intended location of said inner frame.

18. The device according to claim 17, wherein said end of said flange of said outer frame is designed to fit for bearing against an end of a lower flange at an outer circumference of said inner frame, which end is chamfered originating from an upper side of said lower flange and towards a lower side of said lower flange in a downward direction and towards an inner circumference of said inner frame.

19. The device according to claim 1, wherein a cross-section of said inner frame in a horizontal direction is substantially thicker than a cross-section of the outer frame in a horizontal direction.

20. The device according to claim 1, wherein said inner frame and said outer frame are rectangular.

21. A method for clamping and tensioning a textile material in an embroidery frame for a sewing machine comprising an inner frame, an outer frame and a hose arranged between said inner frame and said outer frame, which hose is expanded through pressurization and is pressurized initially such that it expands in an upper part, whereby the textile material is clamped between said upper part of said hose and said outer frame and said hose is thereafter further pressurized such that it is expanded in a lower part, whereby the textile material is tensioned in a direction towards said outer frame, wherein said hose is pressurised initially such that the shape of said hose is rendered to change across said hose in said upper part and is thereafter further pressurized such that the shape of said hose is rendered to change across said hose in said lower part.

22. The method according to claim 21, wherein said hose comprising at least one crease in a transverse direction of said hose in an upper wall and at least one crease in a transverse direction of said hose in a lower wall is initially pressurized such that the at least one crease in a transverse direction of said hose in said upper wall is straightened, whereby said hose is expanded in said upper part and the textile material is clamped at said upper part of said hose between a wall of said hose and an inclining surface at an inner circumference of said outer frame, and said hose is thereafter further pressurised such that the at least one crease in said lower wall of said hose is straightened, whereby a lower part of said hose is expanded into a recess in an inner circumference of said outer frame and the textile material is tensioned in a direction towards said outer frame along a flange of said outer frame.

23. The method according to claim 21, wherein said hose comprising at least one crease in a transverse direction of said hose in an upper wall and at least one crease in a transverse direction of said hose in a lower wall is initially pressurized such that the at least one crease in said upper wall is straightened, whereby said hose is expanded in said upper part and the textile material is clamped at said upper part of said hose between a wall of said hose and a shoulder extending in a horizontal direction at an upper side of said outer frame, and said hose is thereafter further pressurized such that the at least one crease in said lower wall of said hose is straightened, whereby a lower part of said hose is expanded into a recess in an inner circumference of said outer frame, the textile material is folded around a corner of said shoulder at a recess in an inner circumference of said hose and the textile material is tensioned in a direction towards said outer frame along a flange of said outer frame.

24. A device at an embroidery frame for a sewing machine, the device comprising:

an inner frame;

an outer frame; and an expandable hose arranged between the inner frame and the outer frame, the hose comprising a first portion and a second portion, the hose further comprising at least one wave-shaped crease extending in a transverse direction of the hose in at least one of an upper wall and a lower wall, thereby making the first portion and the second portion differentially expandable;

wherein the inner frame, the outer frame, and the hose are operative to retain a textile material arranged between the hose and the outer frame and to apply tension to the textile over an area of the frame.

25. A method for clamping and tensioning a textile material in an embroidery frame including an inner frame, an outer frame and a hose arranged between the inner frame and the outer frame, the method comprising:

arranging a textile material between the hose and one of the inner frame and the outer frame;

expanding a first portion of the hose; and expanding a second portion of the hose;

wherein the hose comprises at least one crease in an upper wall and extending in a transverse direction of the hose and at least one crease in a lower wall and extending in a transverse direction of the hose wherein the hose is expanded through pressurization and initial pressurization of the hose straightens the at least one crease in the upper wall, whereby the hose is expanded in the upper part and the textile material is clamped between the upper part of the hose and the outer frame, and wherein further pressurization of the hose straightens the at least one crease in the lower wall of the hose, whereby the lower part of the hose expands towards the outer frame and the textile material is tensioned in a direction towards the outer frame.

26. A method for clamping and tensioning a textile material in an embroidery frame including an inner frame, an outer frame and a hose arranged between the inner frame and the outer frame, the method comprising:

arranging a textile material between the hose and one of the inner frame and the outer frame;

expanding a first portion of the hose; and expanding a second portion of the hose;

wherein the hose comprises at least one crease in an upper wall and extending in a transverse direction of the hose and at least one crease in a lower wall and extending in a transverse direction of the hose, the hose is expanded through pressurization and initial pressurization of the hose straightens the at least one crease in the upper wall, whereby the upper part of the hose is expanded and the textile material is clamped between the upper part of the hose and the outer frame, and wherein further pressurization of the hose straightens the at least one crease in the lower wall of the hose, whereby the lower part of the hose is expanded into a recess in an inner circumference of said outer frame, whereby the lower part of the hose expands towards the outer frame and the textile material is tensioned in a direction toward the outer frame.

* * * * *